US011712148B2

(12) United States Patent
Sakthivel et al.

(10) Patent No.: US 11,712,148 B2
(45) Date of Patent: Aug. 1, 2023

(54) COLLAPSIBLE RACK FOR DISHWASHER APPLIANCE

(71) Applicant: Haier US Appliance Solutions, Inc., Wilmington, DE (US)

(72) Inventors: Kathirvel Sakthivel, TamilNadu (IN); Chanemougassoundram Raji, Anna nagar (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/401,710

(22) Filed: Aug. 13, 2021

(65) Prior Publication Data

US 2023/0046252 A1 Feb. 16, 2023

(51) Int. Cl.
*A47L 15/50* (2006.01)
*A47L 15/22* (2006.01)

(52) U.S. Cl.
CPC ..... *A47L 15/503* (2013.01); *A47L 15/22* (2013.01); *A47L 15/507* (2013.01)

(58) Field of Classification Search
CPC ..... A47L 15/503
See application file for complete search history.

(56) References Cited

U.S. PATENT DOCUMENTS 5,344,029 A * 9/1994 Oghia ..... A47L 15/505 211/198
5,497,890 A * 3/1996 Clark ..... A47L 15/505 211/198
5,857,473 A * 1/1999 Vanover ..... A47L 15/505 134/201
6,170,676 B1 * 1/2001 Patadia ..... A47L 19/04 211/41.6
6,371,642 B1 * 4/2002 Nelson ..... A47L 15/505 150/900
7,383,846 B2 * 6/2008 Curran ..... A47L 15/505 211/41.6
8,579,120 B2 * 11/2013 Classen ..... A47L 15/507 211/132.1
9,107,552 B2 * 8/2015 Micek ..... A47L 19/04
9,516,990 B2 12/2016 Graute
9,545,185 B2 * 1/2017 Lee ..... A47L 15/4409
9,730,571 B1 * 8/2017 Lee ..... A47L 19/04
9,924,851 B2 * 3/2018 Kulkarni ..... A47L 15/50
9,955,850 B2 * 5/2018 Isbilen ..... A47L 15/503
10,729,305 B2 8/2020 Kopyrin
(Continued)

FOREIGN PATENT DOCUMENTS

CN 105496336 B 11/2018
CN 111067459 A * 4/2020 ..... A47L 15/503
(Continued)

*Primary Examiner* — Joseph L. Perrin
*Assistant Examiner* — Irina Graf
(74) *Attorney, Agent, or Firm* — Dority & Manning, P.A.

(57) ABSTRACT

A dishwasher appliance including at least one upper rack assembly. Adjacent panels along a transverse direction of the dishwasher appliance form a pivotable connection at the longitudinal sides between adjacent panels that allow adjacent panels to collapse or fold towards each other such that the upper rack assembly may be selectively collapsed or extended along the transverse direction by movement of the plurality of panels towards or away from each other.

20 Claims, 12 Drawing Sheets

(56) References Cited

U.S. PATENT DOCUMENTS

2001/0040141 A1* 11/2001 Martorella ..... A47L 19/04 211/41.6
2003/0226580 A1* 12/2003 Welch ..... A47L 15/504 134/201
2006/0219271 A1* 10/2006 Feddema ..... A47L 15/502 134/56 D
2006/0237379 A1* 10/2006 Yang ..... A47L 19/04 211/41.4
2008/0149644 A1* 6/2008 Piacenza ..... A47L 19/04 220/571
2008/0263762 A1* 10/2008 Burns ..... E03C 1/186 4/657
2010/0078048 A1* 4/2010 Schessl ..... A47L 15/504 134/115 R
2010/0314977 A1* 12/2010 Mallory ..... A47L 15/504 312/228.1
2012/0222711 A1* 9/2012 Forst ..... A47L 15/503 312/228.1
2013/0233353 A1* 9/2013 Vacca ..... A47L 15/501 134/25.2
2014/0137907 A1* 5/2014 Shin ..... A47L 15/504 134/135
2014/0239784 A1* 8/2014 Jeong ..... A47J 47/16 312/228.1
2015/0182104 A1* 7/2015 Jeong ..... A47L 15/502 134/92
2017/0172378 A1* 6/2017 Green ..... A47L 19/00
2017/0332879 A1* 11/2017 Gerstner ..... A47L 15/504
2021/0298561 A1* 9/2021 Feddema ..... A47L 15/505
2022/0000332 A1* 1/2022 Kim ..... A47L 15/504

FOREIGN PATENT DOCUMENTS

DE 2755892 A1 * 6/1979 ..... A47L 15/50
EP 2554097 A2 * 2/2013 ..... A47L 15/502
EP 2910170 B1 8/2017
JP 2005118103 A * 5/2005 ..... A47L 15/505
KR 20060095353 A 8/2006
KR 20170021642 A * 2/2017 ..... A47L 15/50
WO WO-2013098009 A1 * 7/2013 ..... A47L 15/502
WO WO2014094897 A1 6/2014
WO WO-2017174565 A1 * 10/2017 ..... E04H 9/021

* cited by examiner

COLLAPSIBLE RACK FOR DISHWASHER APPLIANCE

FIELD OF THE INVENTION

The present disclosure relates generally to dishwasher appliances, and more particularly to a dishwasher appliance with a collapsible or foldable rack.

BACKGROUND OF THE INVENTION

Dishwasher appliances generally include rack assemblies for positioning various articles for cleaning within a wash chamber. One or more devices such as nozzles or spray assemblies may be included at various locations relative to the rack assemblies for purposes of delivering fluids as part of the cleaning process. During the cleaning cycle, the rack assemblies can support and position the articles while also having openings that allow fluid to pass through to the articles. Factors such as the velocity of the fluid, orientation of the fluid spray or stream relative to the articles, the shape and density of the articles in the rack assemblies, and others can impact the effectiveness of the cleaning cycle.

One or more rack assemblies may be used in dishwasher appliances for user convenience. Multiple rack assemblies on multiple levels within dishwasher appliances may allow users to place articles of differing heights and sizes in optimal positions to allow for proper cleaning of the articles. Some dishwasher appliances may include one or more baskets which may also be provided for holding articles, particularly smaller or for more narrow articles such as silverware. Additionally, the user may have the option of e.g., placing articles such as silverware within a basket on a lower rack assembly or placing the silverware directly (without the basket) onto an upper rack assembly specially configured for the receipt of such articles.

The positioning of articles within a dishwasher appliance can affect the fluid dynamics to which the articles are exposed during the cleaning process. For example, articles placed in a lower rack assembly may be subjected to different spray assemblies with different spray patterns, velocities, and spray duration than articles placed in a higher rack assembly. Additionally, the use of multiple racks, such as an upper rack assembly, may limit the size of articles that fit in each rack of the dishwasher appliance. The size of articles that may be placed in a middle rack assembly, for example, may be limited by the addition of an upper rack positioned above the middle rack in the wash chamber. The placing articles of an otherwise inordinately large size in, e.g., a particular rack assembly may limit or inhibit spray assemblies such that a washing cycle may be limited or unable to perform the intended function of cleaning articles within the wash chamber. In some instances, inappropriately large articles may block nozzles and/or spray assemblies, which may prevent the nozzles and/or spray assemblies from reaching at least some articles in the wash tub.

Some dishwasher appliances may further have an upper rack assembly that is partially or totally removable. Such upper rack assembly may be configured for the receipt of e.g., silverware or other small articles. The upper rack assembly may be equipped for user removal from the dishwasher appliance to allow for larger articles to be washed in lower rack assemblies.

However, some users may find removal of an upper rack assembly to be inconvenient. Placing the upper rack assembly outside of the dishwasher appliance during the cleaning cycle may clutter or take up an undesirable amount of additional space outside the dishwasher appliance while the cleaning cycle completes. Such removable rack assemblies may further be prone to part failure, as some removable rack assemblies may require additional parts in comparison with non-removable rack assemblies, the additional parts may result in more opportunities for part failure, repairs, or periodic replacement of the removable rack assemblies.

Accordingly, a dishwasher appliance with an upper rack assembly having the ability to adjust to allow larger articles to be placed in a rack assembly below the upper rack assembly would be useful. For example, a dishwasher appliance having an upper rack assembly having the ability to be moved within the dishwasher appliance to allow for larger articles to be placed below it, without requiring the upper rack assembly to be removed from the dishwasher appliance's wash chamber would be beneficial. A dishwasher appliance configured to also accomplish this task with relatively few or simple parts comprising the rack assembly that had these capabilities would also be desirable.

BRIEF DESCRIPTION OF THE INVENTION

Additional aspects and advantages of the invention will be set forth in part in the following description, or may be apparent from the description, or may be learned through practice of the invention.

In one exemplary embodiment, a dishwasher appliance is provided. The dishwasher appliance includes a tub defining a wash chamber for receipt of articles for washing, at least one rack assembly slidably positioned within the wash chamber and configured for the receipt of articles for washing, at least one spray assembly positioned in the wash chamber near the at least one rack assembly and configured to direct wash fluids at the at least one rack assembly, and an upper rack assembly located above the at least one rack assembly, the upper rack assembly selectively movable along a transverse direction in and out of the wash chamber. The upper rack assembly includes a plurality of collapsible panels, each panel extending longitudinally along a lateral direction of the dishwasher appliance between opposing ends, and each panel having a pair of opposing longitudinal sides. Along the transverse direction, adjacent panels of the dishwasher appliance integrally form a pivotable connection at the opposing longitudinal sides between adjacent panels that allows adjacent panels to fold towards each other such that the upper rack assembly may be selectively moved between a collapsed position or an extended position along the transverse direction by movement of the plurality of collapsible panels towards or away from each other, respectively. During the movement, the plurality of panels remains within a plane that includes the lateral direction and transverse direction.

In another exemplary embodiment, a dishwasher appliance is provided. The dishwasher appliance includes a tub defining a wash chamber for receipt of articles for washing, a first rack assembly slidably positioned within the wash chamber, a first spray assembly positioned in the wash chamber and configured to direct wash fluids at the first rack assembly, a second rack assembly slidably positioned in the wash chamber above the first rack assembly, a second spray assembly positioned in the wash chamber and configured to direct wash fluids at the second rack assembly, a third rack assembly slidably positioned in the wash chamber above the second rack assembly, and a third spray assembly positioned over the third rack assembly and configured to direct wash fluid at articles located in the third rack assembly. The third rack assembly includes a plurality of panels, each panel extending longitudinally along a lateral direction of the dishwasher appliance between opposing ends, each panel having a pair of opposing longitudinal sides. Adjacent panels along a transverse direction of the dishwasher appliance include a pivotable connection at the opposing longitudinal sides between adjacent panels that allows adjacent panels to fold towards each other such that the third rack assembly may be selectively collapsed or extended along the transverse direction by movement of the plurality of panels towards or away from each other, respectively. During the movement, the plurality of panels remains within a plane that includes the lateral and transverse directions.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Use of the same of similar reference numerals in the figures denotes the same or similar features unless the context indicates otherwise.

DETAILED DESCRIPTION OF THE INVENTION

Figure 1:
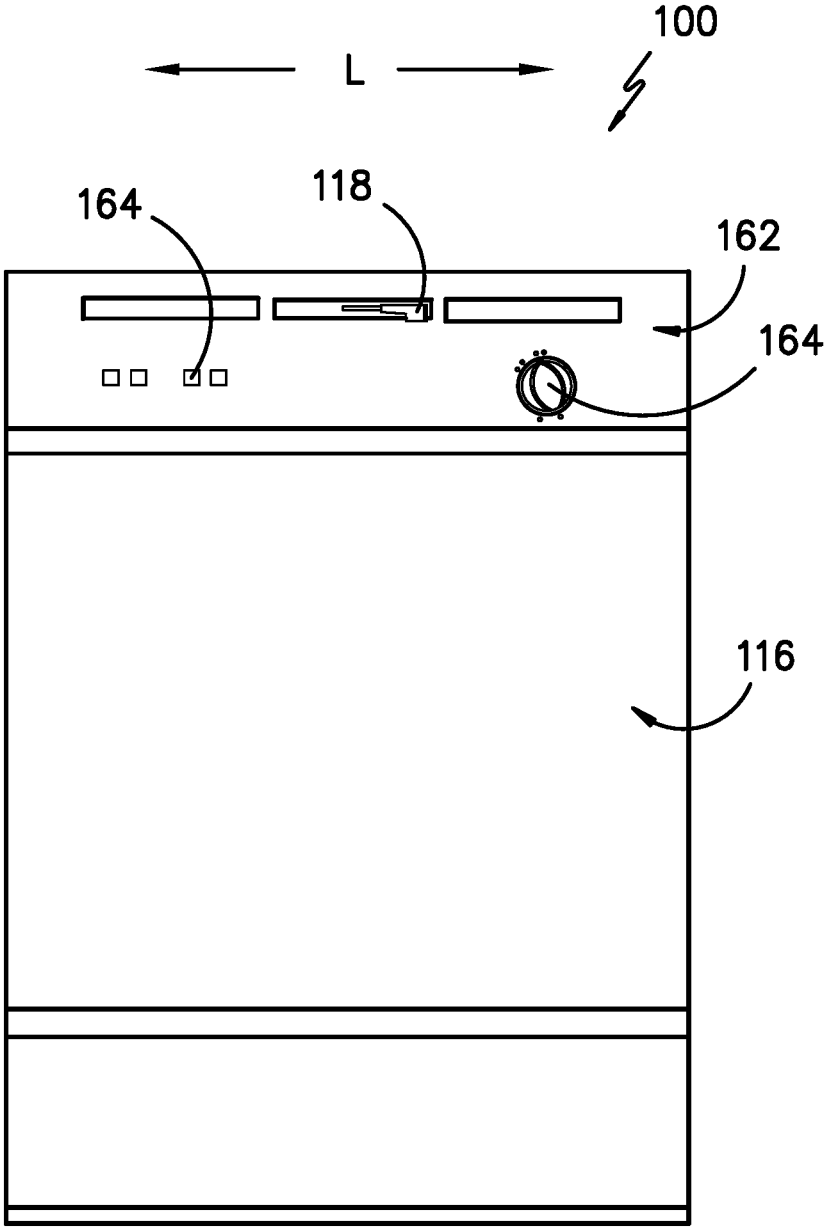
FIG. 1 provides a perspective view of an exemplary embodiment of a dishwashing appliance of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, and/or a drain cycle. The term "wash fluid" refers to a liquid used for washing and/or rinsing the articles and is typically made up of water that may include other additives such as detergent or other treatments.

Figure 2:
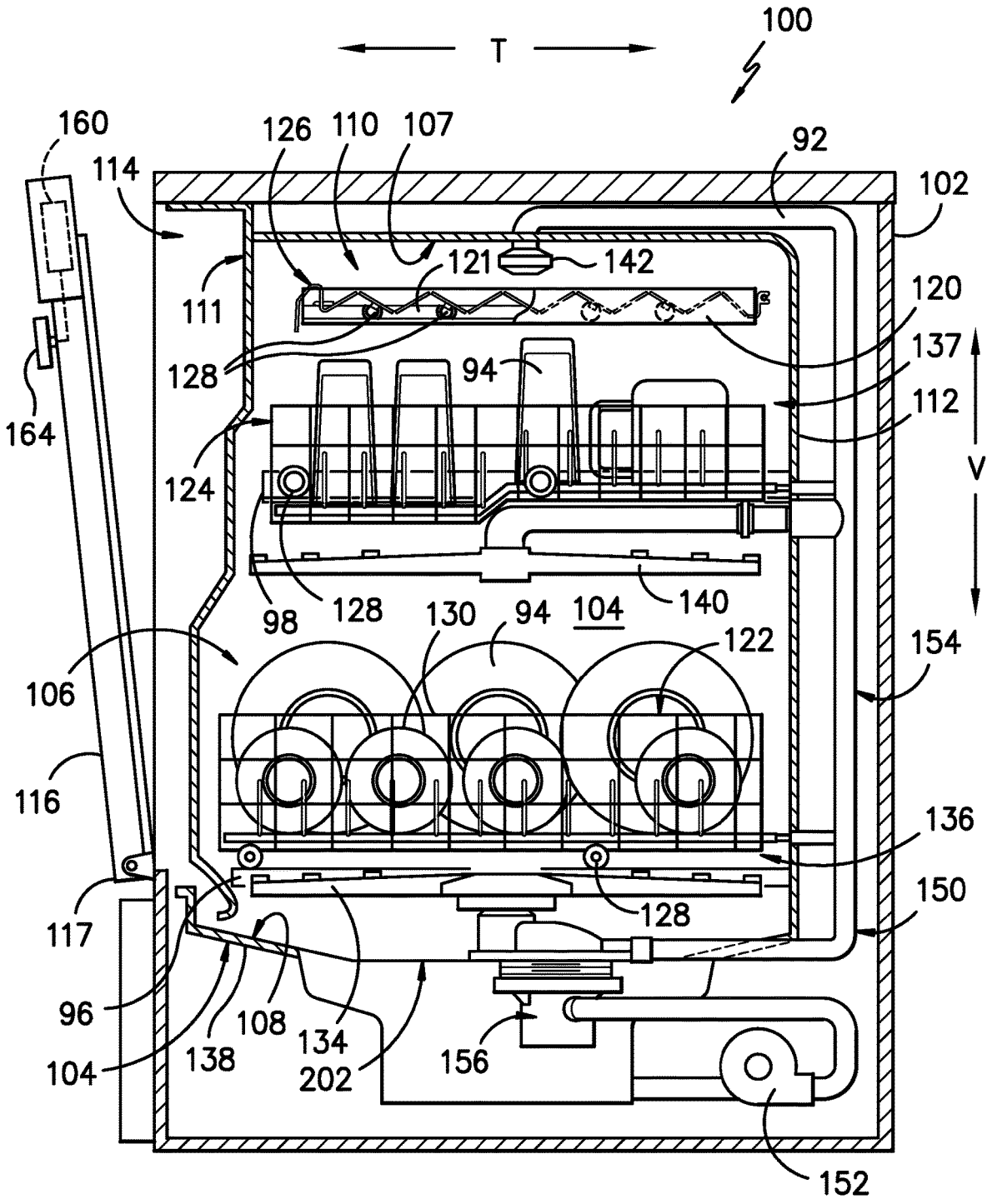
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher appliance 100 includes a cabinet 102 (FIG. 2) having a tub 104 therein that defines a wash chamber 106 for receipt of articles 94 for washing. As shown in FIG. 2, tub 104 extends between a top 107 and a bottom 108 along a vertical direction V, between a pair of opposing side walls 110 along a lateral direction L, and between a front side 111 and a rear side 112 along a transverse direction T. Each of the vertical direction V, lateral direction L, and transverse direction T are mutually perpendicular to one another.

In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

The tub 104 includes a front opening 114 and a door 116 hinged at its bottom 117 for movement between a normally closed vertical position (shown in FIG. 1), wherein the wash chamber 106 is sealed shut for washing operation, and a horizontal open position for loading and unloading of articles from the dishwasher appliance 100. According to exemplary embodiments, dishwasher appliance 100 further includes a door closure mechanism or assembly 118 that is used to lock and unlock door 116 for accessing and sealing wash chamber 106.

At least one rack assembly is slidably positioned within wash chamber 106 and is configured for the receipt of articles for cleaning. For the exemplary embodiment shown in FIG. 2, opposing tub side walls 110 accommodate a plurality of rack assemblies. More specifically, guide rails 96, 98 and 120 may be mounted to (or formed as part of) side walls 110 for supporting a first rack assembly 122 (also referred to as a lower rack assembly 122), a middle rack assembly 124 (also referred to as a second rack assembly 124), and a third rack assembly 126 (also referred to as an upper rack assembly 126). As illustrated, upper rack assembly 126 is positioned at a top portion of wash chamber 106 above middle rack assembly 124, which is positioned above lower rack assembly 122 along the vertical direction V. Additional details regarding the upper rack assembly 126 will be provided herein. For this exemplary embodiment, upper rack assembly 126 is supported on opposing sidewalls 110 by rails 120 but rails 120 could be supported on and attached to middle rack assembly 124 as well.

Each rack assembly 122, 124, 126 is adapted for movement along transverse direction T between an extended loading position (not shown) in which the rack is substantially positioned outside the wash chamber 106, and a retracted position (shown in FIGS. 1 and 2) in which the rack is located inside the wash chamber 106. This may be facilitated, for example, by rollers 128 mounted onto rack assemblies 122, 124, 126, respectively. Although guide rails 96, 98, 120 and rollers 128 are illustrated herein as facilitating movement of the respective rack assemblies 122, 124, 126, it should be appreciated that any suitable sliding mechanism or member may be used according to alternative embodiments. In some embodiments, dishwasher appliance 100 may accommodate a different number of rack assemblies and supporting guide rails. For example, dishwasher appliance 100 may accommodate only first rack assembly 122 and upper rack assembly 126, with accompanying guide rails.

Some or all of the rack assemblies 122, 124, 126 may be fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles 94 within wash chamber 106 while allowing a flow of wash fluid to reach and impinge on those articles, e.g., during a cleaning or rinsing cycle. For some embodiments, a silverware basket (not shown) is removably attached to a rack assembly, e.g., lower rack assembly 122, for placement of silverware, utensils, and the like, that are otherwise too small or delicate to be accommodated by rack 122.

At least one spray assembly is located in wash chamber 106 and is configured to direct wash fluids onto at least on rack assembly for washing articles located therein. For the exemplary embodiment of FIG. 2, dishwasher appliance 100 further includes a plurality of spray assemblies for urging a flow of water or wash fluid onto the articles placed within wash chamber 106. More specifically, as illustrated in FIG. 2, dishwasher appliance 100 includes a first spray assembly 134 (also referred to as a lower spray arm assembly 134) disposed in a lower region 136 of wash chamber 106 and above a sump 138 so as to rotate in relatively close proximity to lower rack assembly 122. Similarly, a second spray assembly 140 (also referred to as a mid-level spray arm assembly 140) is located in an upper region 137 of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, an upper or third spray assembly 142 (also referred to as an upper spray assembly 142) may be located above upper or third rack assembly 126 along the vertical direction V. In this manner, third spray assembly 142 may be configured for urging and/or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear side 112 of tub 104 along the vertical direction V to supply wash fluid throughout wash chamber 106. In some examples, a secondary supply conduit (not shown) may supply additional wash fluid to one or more various spray assemblies and manifolds.

As illustrated, primary supply conduit 154 is used to supply wash fluid to mid-level spray arm assembly 140 while a secondary supply conduit 92 supplies wash fluid to upper spray assembly 142. Diverter assembly 156 can allow selection between spray assemblies 134 and 140, 142 being supplied with wash fluid. However, it should be appreciated that according to alternative embodiments, any other suitable plumbing configuration may be used to supply wash fluid throughout the various spray manifolds and assemblies described herein.

Each spray assembly 134, 140, 142 or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142 may be motor-driven, or may operate using any other suitable drive mechanism. Spray manifolds and assemblies may also be stationary. Movement of the spray arm assemblies 134 and 140 and the spray from fixed manifolds like spray assembly 142 provides coverage of dishes, silverware, and other dishwasher contents and articles 94 to be cleaned with a washing spray. Other configurations of spray assemblies may be used as well. For example, dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber (not shown) for selectively distributing the wash fluid to the spray assemblies 134, 140, 142 and/or other spray manifolds or devices. For example, the diverter disk may have a plurality of apertures that are configured to align with one or more outlet ports (not shown) at the top of diverter chamber (not shown). In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which (e.g., 154) are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counterclockwise direction, a third conduit for spraying rack assembly 126 (shown in FIG. 2) as a silverware rack, and a fourth conduit for supplying only mid-level and/or upper spray assemblies 140, 142. Other configurations of diverter assembly 156 and/or other components (e.g., valves) may be used to allow various choices in the operation of the spray assemblies 134, 140, and 142 during a cleaning cycle.

The dishwasher appliance 100 is further equipped with a controller 160 (FIG. 2) to regulate operation of the dishwasher appliance 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher appliance 100. In the illustrated embodiment, the controller 160 may be located within a control panel area 162 of door 116. In such an embodiment, input/output ("I/O") signals may be routed between the control system and various operational components of dishwasher appliance 100 along wiring harnesses that may be routed through the bottom of door 116. Typically, the controller 160 includes a user interface panel/controls 164 (FIG. 1) through which a user may select various operational features and modes and monitor progress of the dishwasher appliance 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

Dishwasher appliance 100 may also be configured to communicate wirelessly with a cloud-server that may include a database or may be, e.g., a cloud-based data storage system and may also include image recognition and processing capabilities including artificial intelligence as further described below. For example, appliance 100 may communicate with cloud-server over the Internet, and appliance 100 may access via WI-FI®, such as from a WI-FI® access point in a user's home or through a mobile device. Alternatively, dishwasher appliance 100 may be equipped with such image recognition and processing capabilities as part of controller 160 and/or other components onboard appliance 100.

It should be appreciated that the invention is not limited to any particular style, model, or configuration of dishwasher appliance 100. The exemplary embodiment depicted in FIGS. 1 and 2 is for illustrative purposes only. For example, different locations may be provided for user interface 164, different configurations, including providing one or more rack assemblies 122, 124, 126 and one or more spray assemblies 134, 140, 142, to dishwasher appliance 100 may be used, different configurations may be provided for rack assemblies 122, 124, 126, different spray assemblies 134, 140, 142 and spray manifold configurations may be used, and other differences may be applied while remaining within the scope of the present subject matter.

In one exemplary aspect, the present invention provides a collapsible or foldable upper rack assembly that can used to support certain articles (e.g., silverware) during cleaning operations. The upper rack assembly can also be conveniently collapsed or folded for storage within the dishwasher in a manner that creates space or room for articles positioned in another rack assembly located below the upper rack assembly. In some embodiments, the upper rack assembly may also be conveniently removable from the appliance. Additional exemplary aspects of the present invention are set forth, or will be apparent from, the description that follows of an exemplary embodiment of an upper rack assembly 126.

With reference to FIGS. 2 through 9, dishwasher appliance 100 includes an exemplary upper rack assembly 126 that is located above at least one rack assembly such as middle rack assembly 124. As will be further described, upper rack assembly 126 may be supported directly on opposing walls of 110 of appliance. In either embodiment, the user can selectively move the upper rack assembly 126—along transverse direction T—in and out of the wash chamber 106 for purposes of loading and unloading articles.

Upper rack assembly 126 includes a plurality of panels 168 connected together and collapsible or foldable onto each other. Each panel 168 extends longitudinally along a lateral direction L of the dishwasher appliance 100 between opposing ends 174 and 176. Each panel 168 also includes a pair of opposing longitudinal sides 170 and 172 (FIG. 8) extending along lateral direction L.

Panels 168 are adjacent to each other along transverse direction T and form a pivotable connection 180 at longitudinal sides 170 and 172. For example, adjacent panels $\mathbf{168}_F$ and $\mathbf{168}_B$ (FIGS. 3, 4, and 5) form a pivotable connection 180 at respective longitudinal sides $\mathbf{172}_F$ and $\mathbf{170}_B$ between adjacent panels $\mathbf{168}_F$ and $\mathbf{168}_B$. Pivotable connection 180 allows adjacent panels $\mathbf{168}_F$ and $\mathbf{168}_B$ to pivot and fold towards each other along transverse direction T so that upper rack assembly 126 can be collapsed into a smaller width along transverse direction T.

More particularly, upper rack assembly 126 may be selectively collapsed (e.g., as depicted by arrows C in FIG. 4) or extended (e.g., as shown by arrow E in FIG. 5) along the transverse direction T by movement of the plurality of panels 168 towards or away from each other, respectively. For this exemplary embodiment, while moving between the extended position (shown in FIGS. 2, 3, 4, and 6) or the folded/collapsed position (shown in FIG. 5)—the plurality of panels 168 remain vertically centered about a plane 178 (FIG. 4) that includes lateral direction L and transverse direction T.

While moving between the extended position (shown in FIGS. 2, 3, 4, and 6) or the folded/collapsed position (shown in FIG. 5)—alternating pivotable connections 180 move closer or farther away from each other along transverse direction T. More particularly, with reference to FIGS. 4 and 5, upper pivotable connections 180*u* move closer or further away from each other along transverse direction T as upper rack assembly 126 is folded or extended and remain within vertically centered about a plane that includes lateral direction L and transverse direction T. Similarly, lower pivotable connections $\mathbf{180}_L$ move closer or further away from each other along transverse direction T as upper rack assembly 126 is folded or extended and remain vertically centered about a plane that includes lateral direction L and transverse direction T. As used herein, the term "vertically centered" when used to describe the movement of upper rack assembly 126 means that in the extended position, plurality of panels 168 are aligned with plane 178 and in the folded or partially folded position plurality of panels are centered about plane 178. For example, plane 178 includes lateral direction L and transverse direction T.

Figure 5:
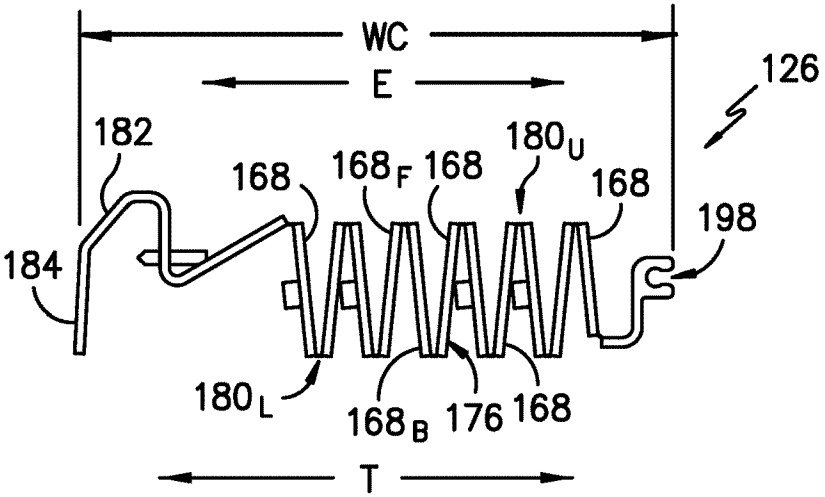
FIG. 5 provides a side view of the upper rack assembly of FIG. 3 shown in a folded or collapsed position according to an exemplary embodiment of the present subject matter.

The collapsibility of upper rack assembly 126 allows for the positioning of larger articles for washing in the rack assembly directly below (along vertical direction V) the upper rack assembly 126. For example, with reference to the extended position shown in FIG. 2, upper rack assembly 126 might otherwise inhibit the inclusion of larger articles in second rack assembly 124. However, upper rack assembly 126 can be collapsed or folded (as shown in FIG. 5) to allow for more vertical space above second or middle rack assembly 124. In some embodiments, dishwasher appliance may only include upper/third rack assembly 126 and first rack assembly 122, in which case, collapsing upper rack assembly 126 would allow for more vertical space above first rack assembly 122. Accordingly, upper rack assembly 126 allows for a larger space above at least one lower rack assembly when the upper rack assembly 126 is in the collapsed or folded position.

In one exemplary aspect, when in the folded or collapsed position, upper rack assembly 126 may have a width WC along transverse direction T (FIG. 5) that is about one-third or less than the width WE along transverse direction T (FIG. 4) of the upper rack assembly 126 in the extended position. In another exemplary aspect, when in the folded or collapsed position, upper rack assembly 126 may have a width WC along transverse direction T (FIG. 5) that is about one-fourth (twenty-five percent) or less than the width WE along transverse direction T (FIG. 4) of the upper rack assembly 126 in the extended position. In still another exemplary aspect, when in the folded or collapsed position, upper rack assembly 126 may have a width WC along transverse direction T (FIG. 5) that is about one-tenth or less than the width WE along transverse direction T (FIG. 4) of the upper rack assembly 126 in the extended position.

A variety of different configurations and constructions may be used to form pivotable connection 180. For the embodiment of FIGS. 2 through 9, pivotable connection 180 is integrally formed as a living hinge or pleat 181 that allows upper rack assembly 126 to fold and unfold (e.g., collapse and extend) in an accordion-like manner. As used herein, a "living hinge" or "pleat" is as a flexible component that may be made from the same material as the adjacent panels that it connects and that may be thinner than such adjacent panels.

Figure 9:
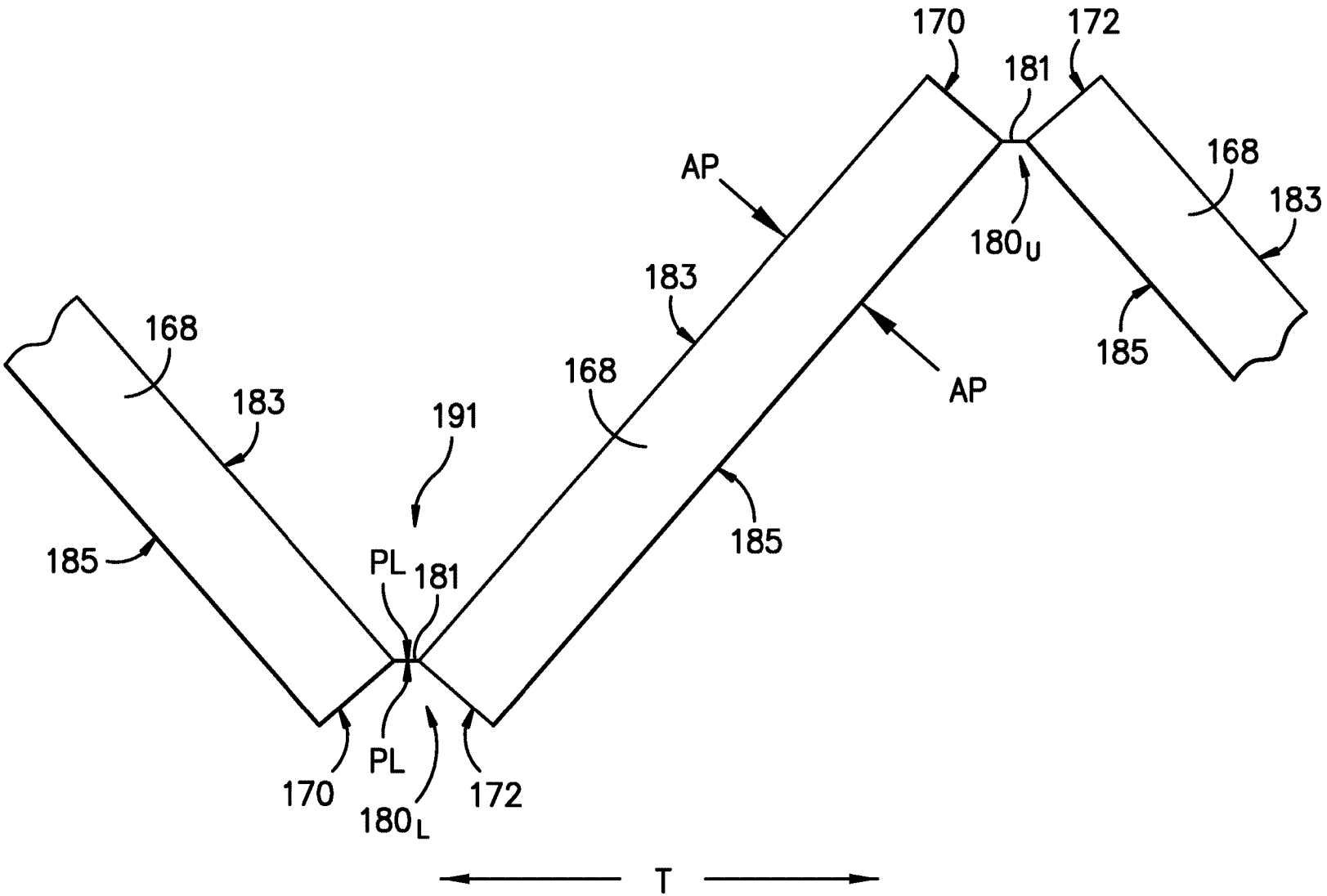
FIG. 9 is a close-up, side view of exemplary pivotable connections of the present invention.

More particularly and with reference to FIG. 9, for this exemplary embodiment, each pivotable connection 180 is a pleat 181 that is integrally formed at sides 170 and 172 of two adjacent panels 168. For example, pleats 181 may be formed from the same materials creating panels 168. Such materials of construction may include plastics (e.g., polypropylene, high density polyethylene and low-density polyethylene), metals (e.g., wires, sheets, and stamped sheets), and combinations thereof (e.g., coated wires or coated metal sheets). The construction material is selected so as to have a flexibility and resilience that allows for folding and unfolding at pleats 181. Along transverse direction T, pleats 181 alternate positioning between top surface 183 and bottom surface 185 of upper rack assembly 126. Pleats 181 may be continuous along lateral direction L between ends 174 and 176 of panels 168 or may be discontinuous—having gaps or openings therein for the passage of fluid.

Each pleat 181 has a thickness PL. In one exemplary embodiment, thickness PL may be about 20 percent or less than the thickness AP of a panel 168. In still another embodiment, an exemplary thickness for panel 168 may be between about 0.05 inches and 0.1 inches while pleat thickness PL may be between 0.010 inches and 0.0020 inches. Other thicknesses for PL and AP may be used in other embodiments of the invention.

For the exemplary embodiment of FIGS. 2 through 9, in an extended position upper rack assembly 126 forms a plurality of adjacent channels or troughs 191 (FIGS. 4 and 9) into which various articles (e.g., silverware) may be placed for cleaning. Each trough 191 is formed by adjacent panels 168 and includes a pleat 181 at the bottom of trough 191 along vertical direction V. Panels 168 may also be provided with perforations or openings 187 through which fluids may pass during a washing process.

Figure 4:
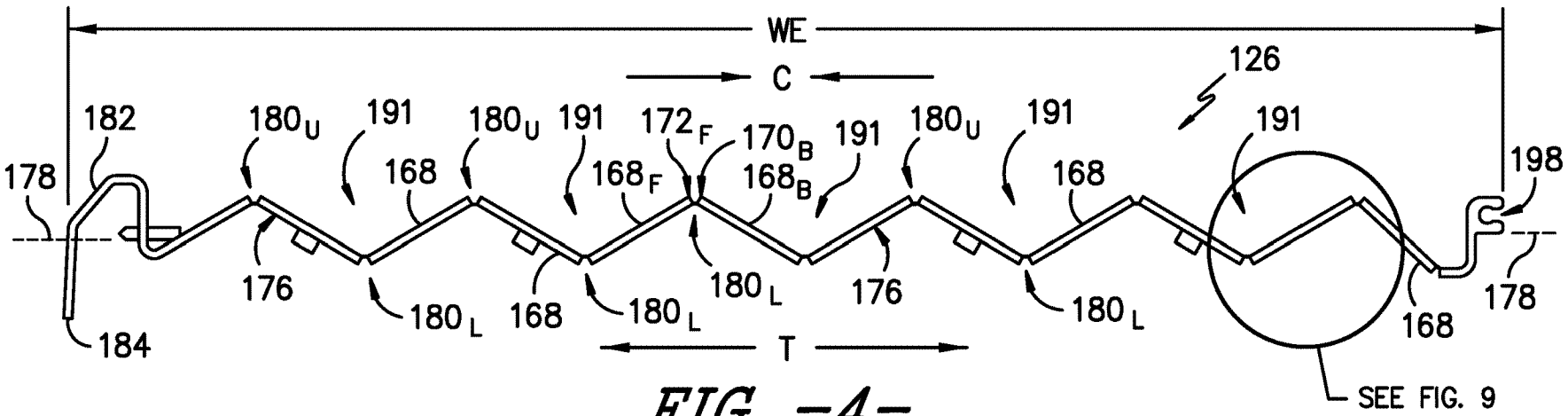
FIG. 4 provides a side view of the upper rack assembly of FIG. 3 shown in an extended position according to an exemplary embodiment of the present subject matter.

As shown in FIGS. 4 and 5, panel 168 are each similarly sized. However, in other embodiments of the invention, panels 168 of varying sizes may be used. For example, along transverse direction T, panels 168 of alternating sizes may be employed. Other configurations of panels 168 may be used as well.

Figure 6:
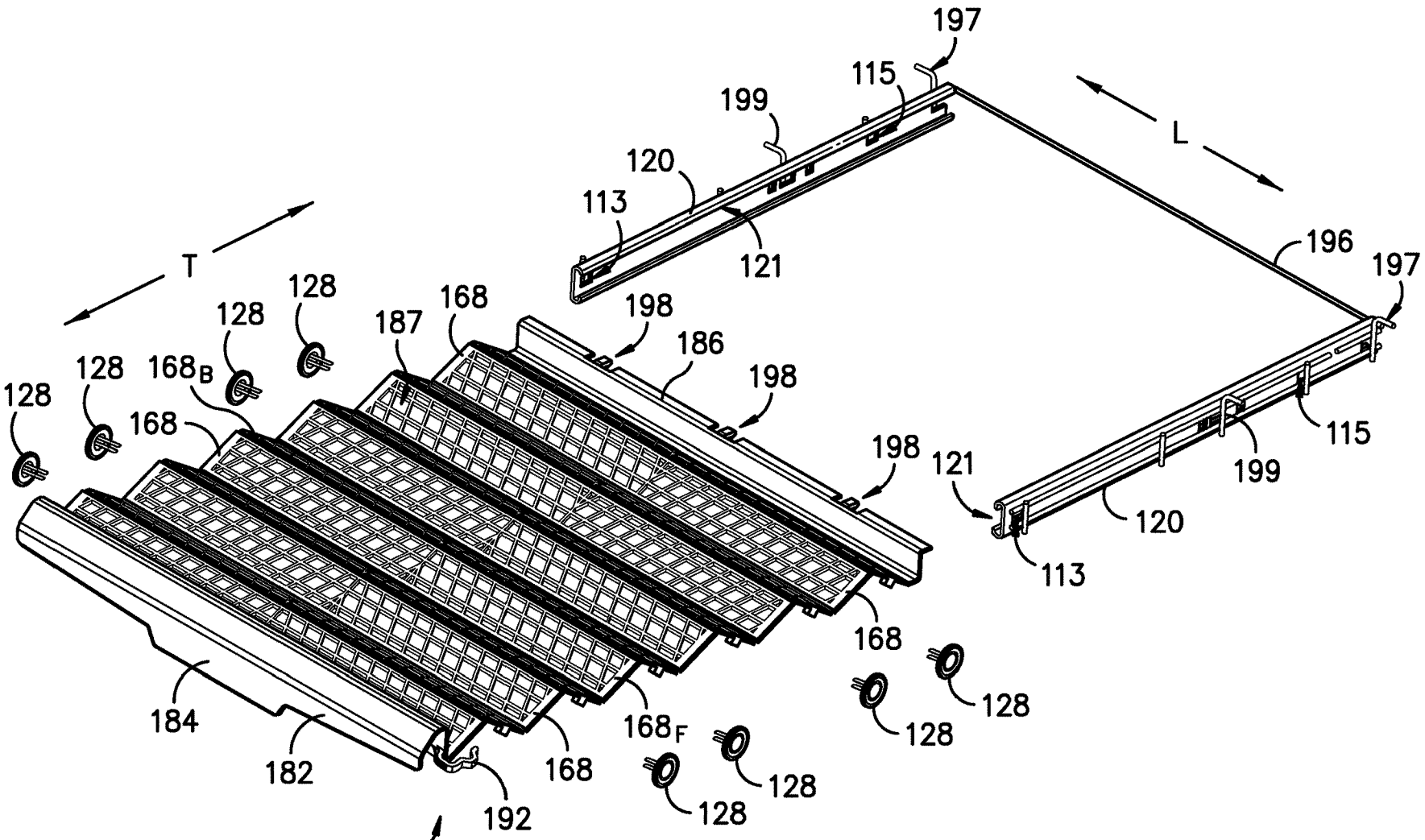
FIG. 6 is a perspective view of the upper rack assembly of FIG. 3 shown in an extended position with exemplary guide rails and exploded related parts as will be further described.

As mentioned, upper rack assembly 126 may be configured to be removably supported on opposing sides 110 of the appliance 100. Referring to FIGS. 2 and 6, a pair of opposing guide rails 120 are positioned adjacent to the lateral sides of upper rack assembly 126. A plurality of rollers 128 are connected at panel ends 174, 176 and are slidably received into opposing tracks 121 (FIG. 2) formed by opposing guide rails 120. When upper rack assembly 126 is retracted or extended along transverse direction T, rollers 128 move along tracks 121 of guide rails 120 and maintain panels 168 within plane 178 (FIG. 4) formed by lateral direction L and transverse direction T. In some embodiments, slides may be used to allow the upper rack assembly 126 to slide along guide rails 120 in place of, or in addition to, rollers 128. Other equivalent mechanisms for moving the upper rack assembly 126 may also be used.

Referring again to FIG. 6, a back support rod 196 includes opposing hooks 197. Additional opposing hooks 199 are positioned about mid-way along the length of each guide rail 120 along transverse direction T. Hooks 197 and 199 allow upper rack assembly 126 to be aligned and removably positioned onto opposing sides 110 of the appliance 100.

Opposing hooks 197 and 199 secure upper rack assembly 126 into position on opposing sides 110 while a user is extending or folding panels 168. At the same time, a user may easily remove the entire upper rack assembly 126 if additional space in middle rack assembly 124 is needed beyond the extra space provided by folding or retracting panels 168. Other features may also be used to removably position upper rack assembly 126 on opposing side 110 as will be understood by one of ordinary skill in the art using the teachings disclosed herein.

Figure 3:
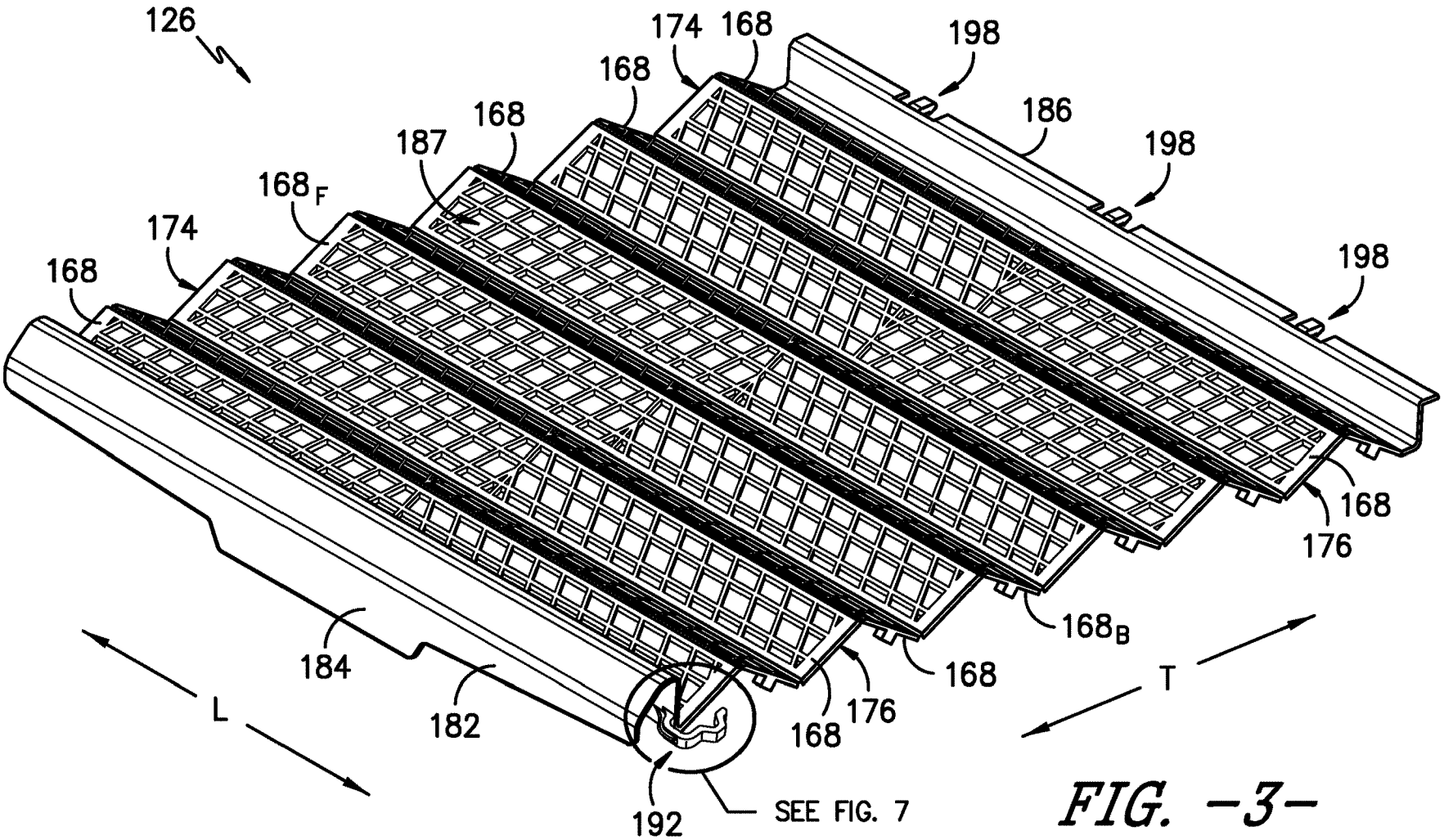
FIG. 3 provides a perspective view of an upper or third rack assembly of the exemplary dishwashing appliance of FIG. 1 with the upper rack assembly in an extended position according to an exemplary embodiment of the present subject matter.

As depicted in FIGS. 3 and 6, upper rack assembly 126 may include a front section 182 having a handle 184 that allows a user to readily expand and collapse the upper rack assembly 126 by movement along transverse direction T. Front section 182 may be constructed from the same materials as panels 168 or a different material may be used.

Upper rack assembly 126 may also include a back section 186 configured to attach upper rack assembly 126 to back support rod 196. As shown, back support rod 196 extends along lateral direction L. One or more clips 198 spaced apart along lateral direction L on back section 186 are used to connect back section 186 to back support rod 196. As such, rod 196 forms an anchor to prevent back section 186 from moving along transverse direction T when panels 168 are unfolded.

Figure 7:
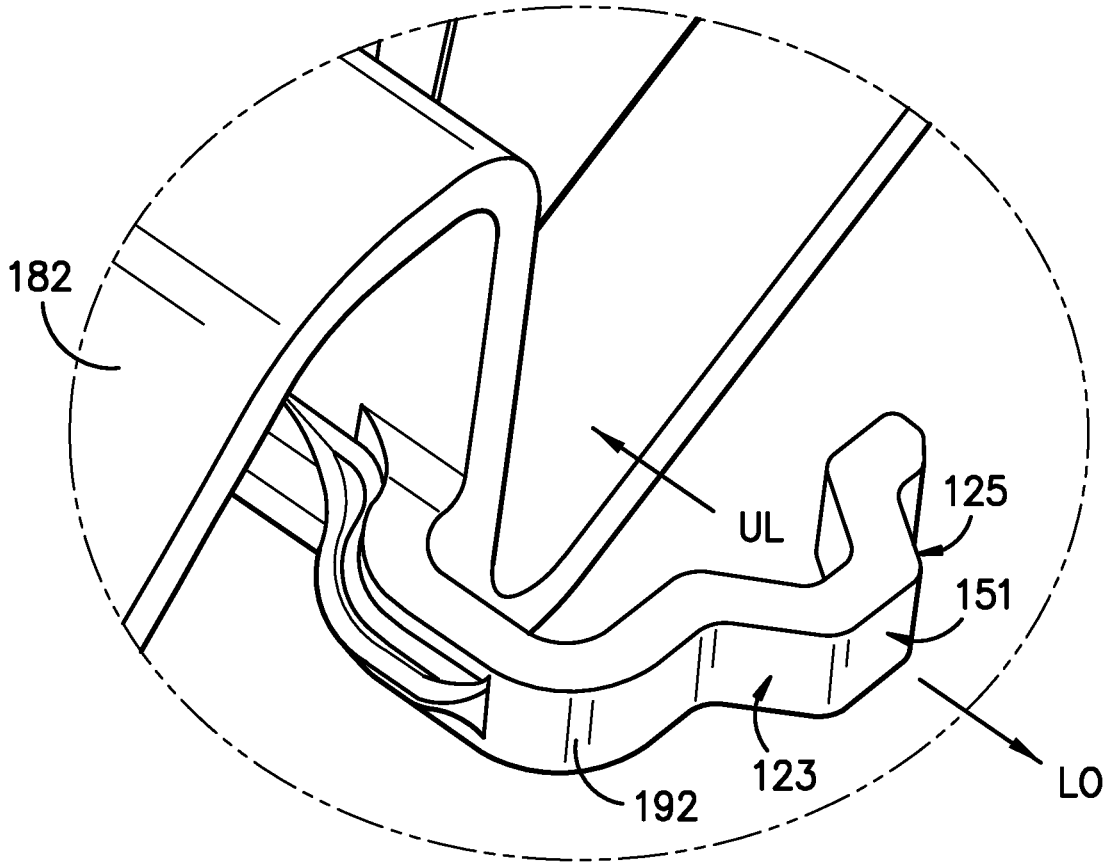
FIG. 7 provides a perspective view of an exemplary lock of the upper rack assembly of FIG. 3.
Figure 8:
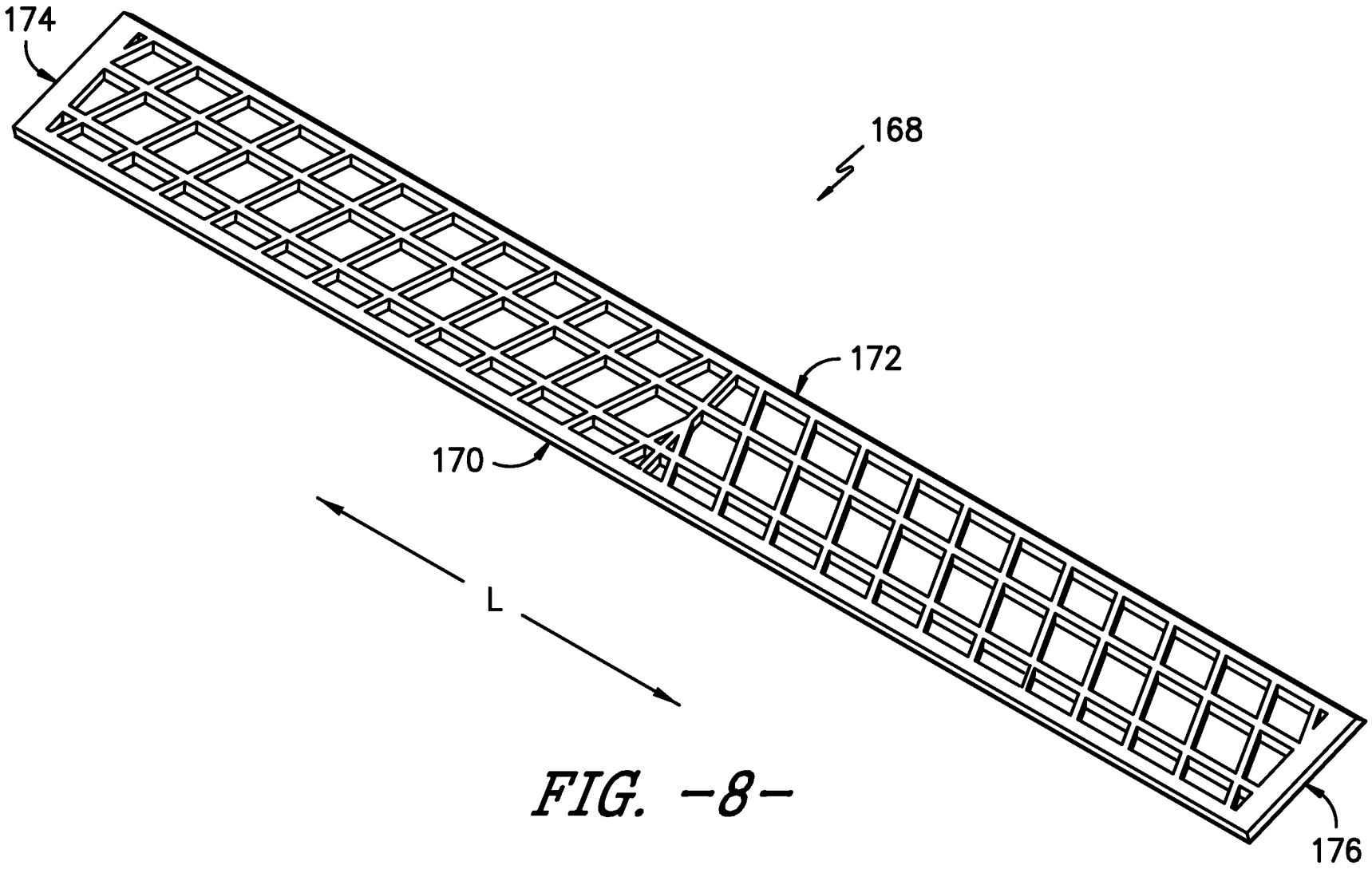
FIG. 8 provides a perspective view of an exemplary panel of the present invention.

As shown in FIGS. 3, 6, and 7, upper rack assembly 126 may further include a lock 192 to selectively fix the position of upper rack assembly 126 along transverse direction T. More particularly, lock 192 may be used to selectively fix upper rack assembly 126 at a fully folded position, fully extended position, or intermittent positions therebetween. For this exemplary embodiment, lock 192 extends laterally from front section 182 and includes a detent 151 that is movable (arrows UL and LO) along lateral direction L. Although one lock 192 is shown in FIG. 6, upper rack assembly 126 may include another lock 192 positioned in an opposing manner.

Guide rails 120 include multiple opposing pairs of slots 113 and 115 that are each configured to receive detents 151. Along each rail 120, slots 113 and 115 are spaced apart along transverse direction T. For example, detents 151 are biased outwardly along lateral direction L and can be removably received into slots 113 to selectively lock upper rack assembly 126 into an extended position. Alternatively, detents 151 can be received into slots 115 to selectively lock or fix the position of upper rack assembly 126 into a collapsed or folded position. Each lock 192 includes a front ramp 123 and a rear ramp 125 on opposing transverse sides of detent 151. In order to release detent 151 from one of the slots, a user can either push or pull upper rack assembly 126 along transverse direction T, which will cause lock 192 to slide out of the slot along either front ramp 123 or rear ramp 125. Lock 192 will be moved in the direction of arrow UL and out of the slot so as to unlock upper rack assembly 126. Upon reaching another slot, lock 192 is biased outwardly and will move in the direction of arrow LO so as to selectively fix or lock upper rack assembly 126 into the user desired position along transverse direction T.

Upper rack assembly 126 may also be configured to be locked into multiple positions in between a collapsed position and an extended position by use of a multiplicity of slots located on the guide rails 120 between slots 113 and 115. Other configurations and equivalent embodiments of the lock 192 may be utilized to hold the upper rack assembly 126 in collapsed, folded, or intermediate positions. Still other configurations and constructions may be utilized to hold the upper rack assembly 126 in an extended position. Although slots are shown along each guide rail 120, in another exemplary embodiment, slots may be positioned along only one guide rail 120 to work with a single lock 192 on the same side of upper rack assembly 126.

Figure 10:
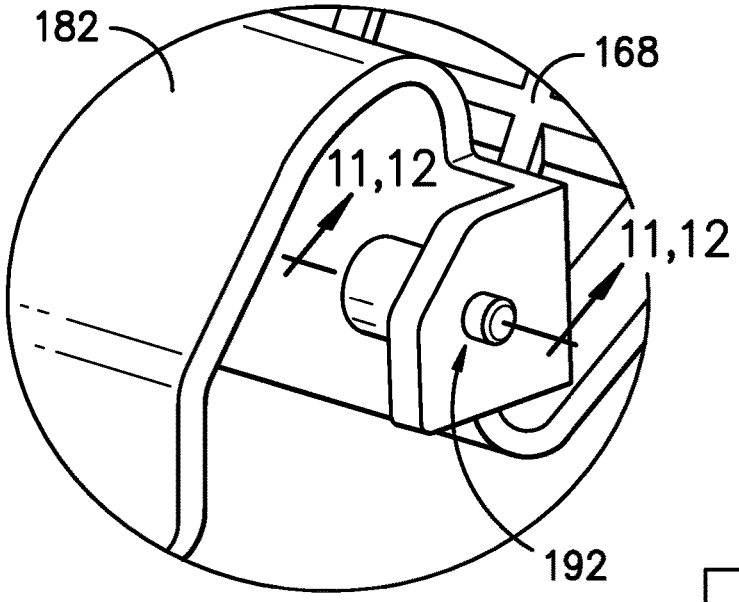
FIGS. 10, 11, and 12 illustrate another exemplary embodiment of a lock of the present invention with FIGS. 11 and 12 being cross-sectional views showing the lock in an extended position and retracted position, respectively.
Figure 11:
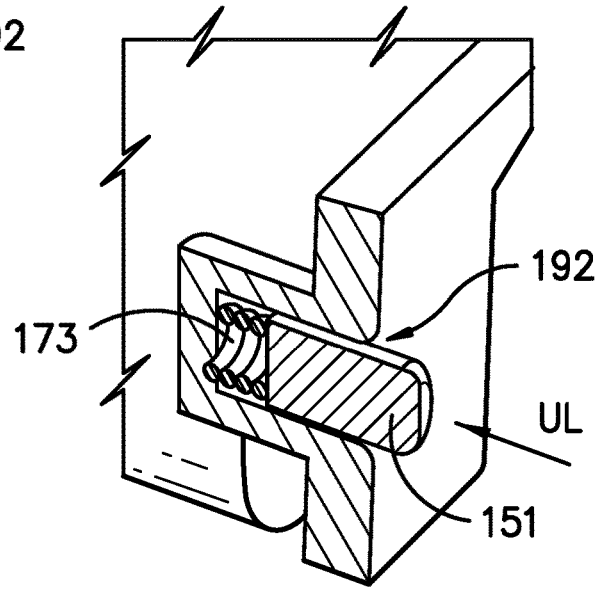
Figure 12:
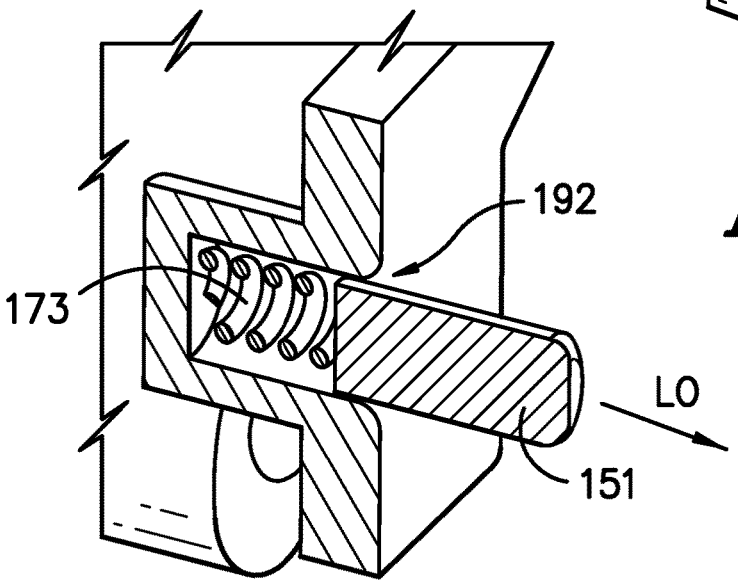

FIGS. 10, 11, and 12 depict another embodiment of lock 192 and detent 151, which may also be deployed on one or both lateral sides of upper rack assembly 126. In this embodiment, detent 151 is urged outwardly (arrow LO) along lateral direction L by a spring 173. When detent 151 is deployed with a slot 113 or 115, a user may depress detent along the direction of arrow UL to compress spring 173 and allow a user to collapse or extend upper rack assembly 126 as previously described. Upon reaching a slot, spring 173 will cause detent 151 to move in the direction of arrow LO and into the slot to selectively fix the position of upper rack assembly as previously described.

In an alternative embodiment, upper rack assembly 126 may be supported directly on opposing side walls 110 of appliance 100. In such case, a pair of opposing drawer slides may be directly attached to side walls 110 of appliance 100 and connected with upper rack assembly 126. For example, rollers 128 may be received into guides provided by the drawer slides and move within the drawer slides to collapse or fold panels 168 as previously described. The drawer slides can be used to move the entire upper rack assembly 126 back and forth along transverse direction T in and out of wash chamber 106 independently of the movement of rollers 128.

Figure 13:
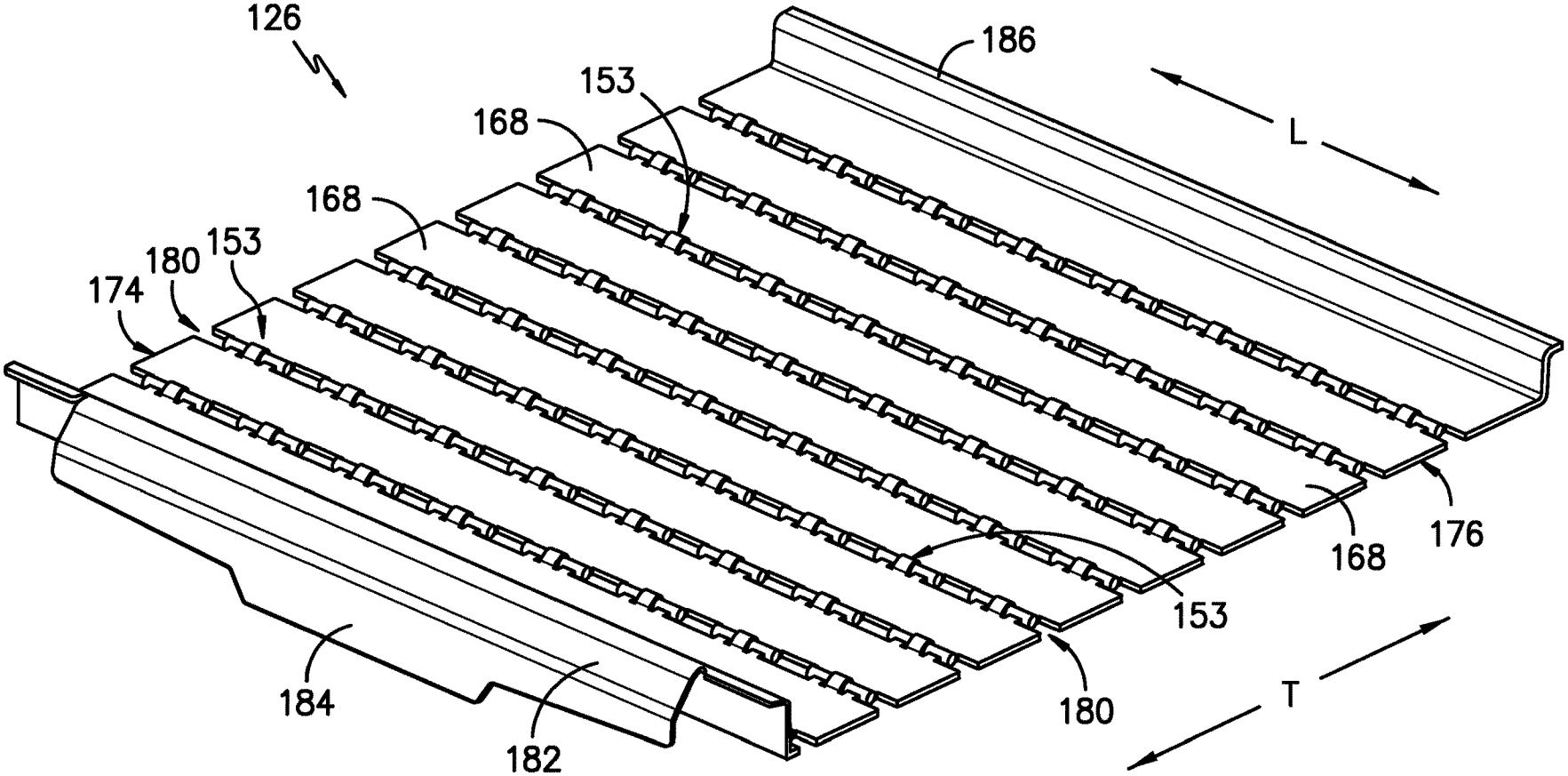
FIG. 13 provides a perspective view of another exemplary upper rack assembly, which is shown in an extended position.
Figure 14:
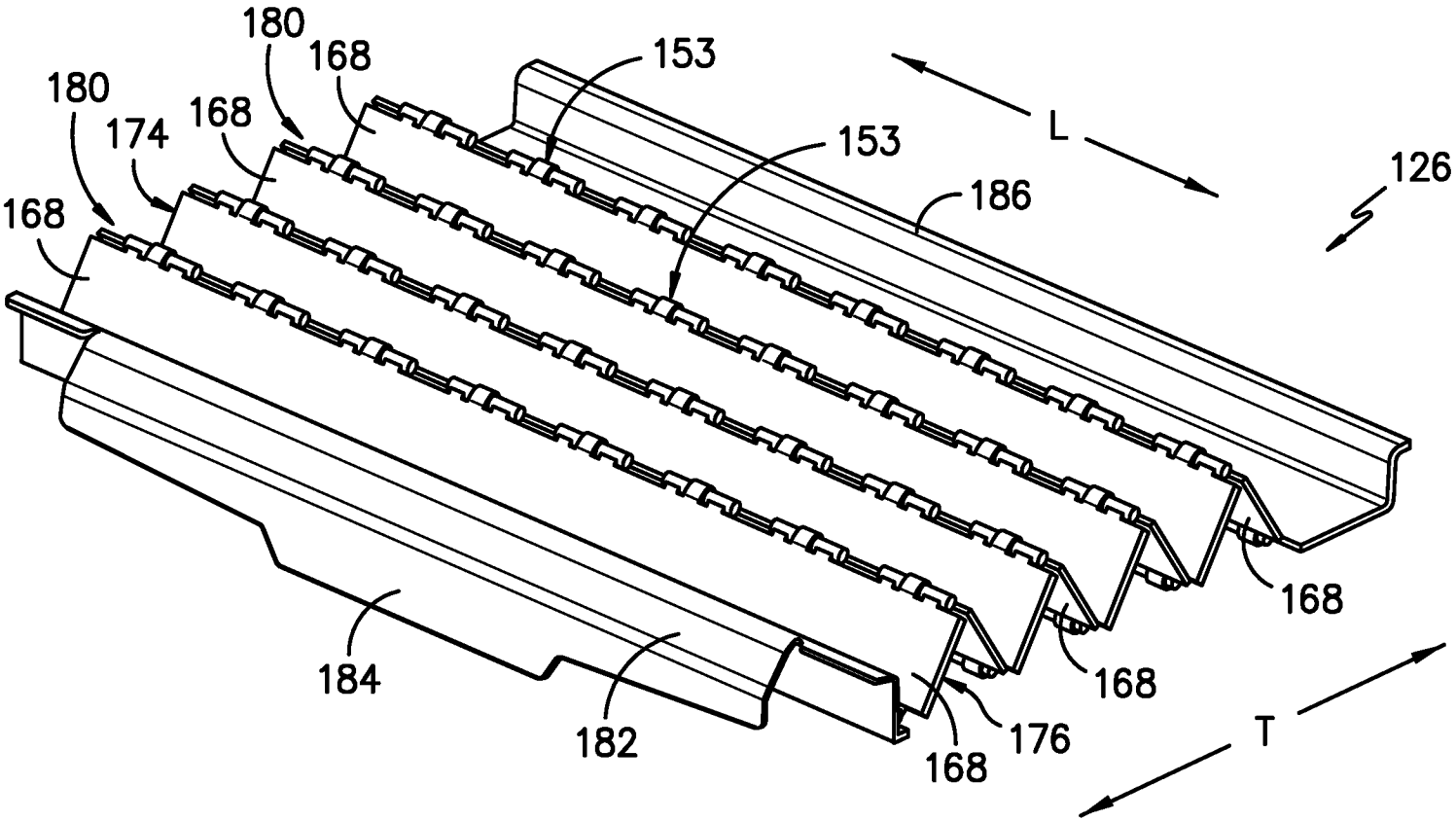
FIG. 14 provides a perspective view of the exemplary upper rack assembly of FIG. 13 but shown in a collapsed or folded position.
Figure 15:
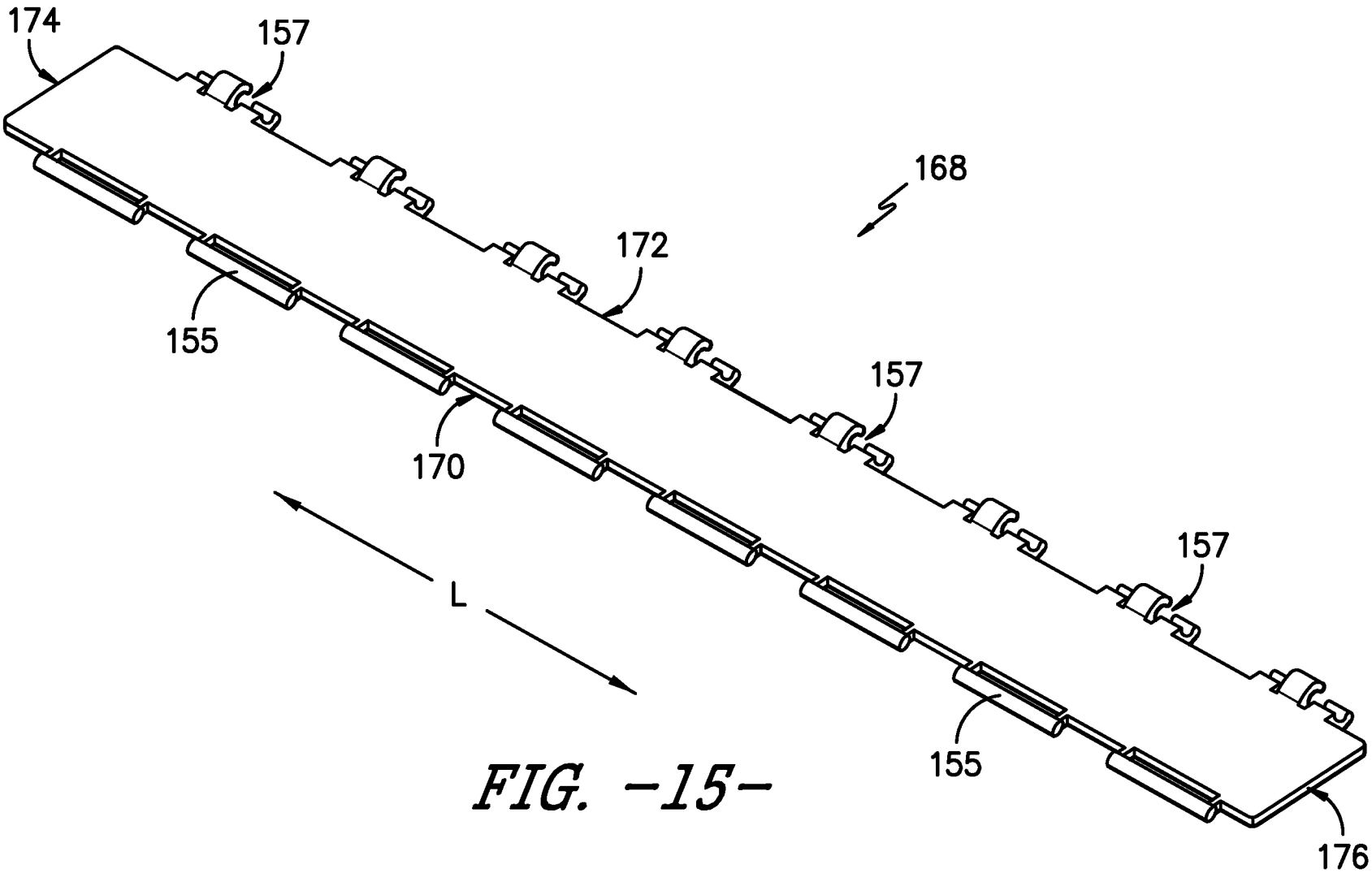
FIG. 15 is a perspective view of an exemplary panel of the present invention.

FIGS. 13, 14, and 15 illustrate another exemplary embodiment of upper rack assembly 126. FIG. 13 depicts upper rack assembly 126 in an extended position and FIG. 14 depicts upper rack assembly in a collapsed position. As with previous embodiments, panels 168 form a pivotable connection 180 at the longitudinal sides 170 and 172 between two adjacent panels. For this embodiment, pivotable connection 180 includes a plurality of hinges 153 formed by longitudinal sides 170 and 172 of adjacent panels 168. More specifically, each hinge 153 is constructed from an axle 155 positioned on longitudinal side 170 of one panel 168 that is snapped or clipped into an axle receiver 157 positioned on longitudinal side 172 of an adjacent panel 168. Hinges 153 are spaced apart along lateral direction L. For this embodiment, hinges 153 allow the panels 168 to completely flatten into a single plane that includes both lateral direction and transverse direction T. Other constructions may be used to create pivotable connection 180 as will be understood by one of ordinary skill in the art using the teachings disclosed herein. Although not shown with perforations, such may be added to panels 168.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber for receipt of articles for washing;

at least one rack assembly slidably positioned within the wash chamber and configured for the receipt of articles for washing;

at least one spray assembly positioned in the wash chamber near the at least one rack assembly and configured to direct wash fluid at the at least one rack assembly;

a pair of opposing guide rails positioned in the wash chamber; and an upper rack assembly located above the at least one rack assembly, the upper rack assembly being supported by the pair of opposing guide rails and being selectively movable along a transverse direction in and out of the wash chamber, the upper rack assembly comprising:

a plurality of collapsible panels, each panel extending longitudinally along a lateral direction of the dishwasher appliance between opposing ends, each panel has a pair of opposing longitudinal sides; and a plurality of rollers connected at the opposing ends of at least one of the plurality of collapsible panels, each of the plurality of rollers being slidably received within tracks in the pair of opposing guide rails, wherein along the transverse direction, adjacent panels of the plurality of collapsible panels integrally form a pivotable connection at the opposing longitudinal sides between adjacent panels that allows adjacent panels to fold towards each other such that the upper rack assembly may be selectively moved between a collapsed position and an extended position along the transverse direction in an accordion-like manner by movement of the plurality of collapsible panels towards or away from each other, respectively, wherein during the movement, the plurality of rollers slide within the tracks, and wherein during the movement, the plurality of collapsible panels remains vertically centered about a plane that includes the lateral direction and the transverse direction.

2. The dishwasher appliance of claim 1, wherein each pivotable connection comprises a pleat.

3. The dishwasher appliance of claim 2, wherein each pleat has a pleat thickness and each panel has a panel thickness, wherein the pleat thickness is less than the panel thickness.

4. The dishwasher appliance of claim 3, wherein the pleat thickness is 20 percent or less than the panel thickness.

5. The dishwasher appliance of claim 1, wherein each pivotable connection between adjacent panels comprises a plurality of hinges formed by the longitudinal sides of adjacent panels, the hinge comprising an axle; and an axle receiver into which the axle is removably received, the axle being rotatable relative to the axle receiver.

6. The dishwasher appliance of claim 1, wherein the upper rack assembly is supported on opposing sides of the dishwasher appliance.

7. The dishwasher appliance of claim 1, further comprising a lock configured to selectively fix a position of the upper rack assembly along the transverse direction.

8. The dishwasher appliance of claim 7, wherein the lock is further configured with a detent that is configured to be removably received into at least one slot located on at least one of the opposing guide rails.

9. The dishwasher appliance of claim 7, wherein at least one of the opposing guide rails defining one or more slots spaced apart along the transverse direction, and wherein the lock comprises a detent configured to be removably received into the one or more slots.

10. The dishwasher appliance of claim 9, wherein the at least one opposing guide rail comprises at least two slots configured to allow the lock to selectively fix the upper rack assembly in at least two positions along the at least one opposing guide rail.

11. The dishwasher appliance of claim 7, wherein the lock comprises at least two locks located on opposing sides of the upper rack assembly such that the at least two locks are configured to selectively fix the upper rack assembly in the collapsed position or the extended position along the pair of opposing guide rails.

12. The dishwasher appliance of claim 1, wherein the upper rack assembly is movable along the transverse direction between the extended position and the collapsed position, and wherein in the collapsed position the upper rack assembly has a width along the transverse direction that is about twenty-five percent or less from the width in the extended position.

13. The dishwasher appliance of claim 12, wherein the upper rack assembly allows for a larger space above the at least one rack assembly when the upper rack assembly is in the collapsed position.

14. A dishwasher appliance, comprising:

a tub defining a wash chamber for receipt of articles for washing;

a first rack assembly slidably positioned within the wash chamber;

a first spray assembly positioned in the wash chamber and configured to direct wash fluid at the first rack assembly;

a second rack assembly slidably positioned in the wash chamber above the first rack assembly;

a second spray assembly positioned in the wash chamber and configured to direct wash fluid at the second rack assembly;

a pair of opposing guide rails positioned in the wash chamber;

a third rack assembly supported by the pair of opposing guide rails and being slidably positioned in the wash chamber above the second rack assembly; and a third spray assembly positioned over the third rack assembly and configured to direct wash fluid at articles located in the third rack assembly;

the third rack assembly comprising:

a plurality of panels, each panel extending longitudinally along a lateral direction of the dishwasher appliance between opposing ends, each panel has a pair of opposing longitudinal sides; and a plurality of rollers connected at the opposing ends of at least one of the plurality of collapsible panels, each of the plurality of rollers being slidably received within tracks in the pair of opposing guide rails, wherein the plurality of panels forms a plurality of pleats, wherein the pleats alternate between a top surface and a bottom surface of the third rack assembly, wherein adjacent panels along a transverse direction of the dishwasher appliance include a pivotable connection at the opposing longitudinal sides between adjacent panels that allows adjacent panels to fold towards each other such that the third rack assembly may be selectively collapsed or extended along the transverse direction in an accordion-like manner by movement of the plurality of panels towards or away from each other, respectively, wherein during the movement, the plurality of rollers slide within the tracks, and wherein during the movement, the plurality of panels remains vertically centered about a plane that includes the lateral and transverse directions.

15. The dishwasher appliance of claim 14, wherein each pivotable connection comprises a pleat.

16. The dishwasher appliance of claim 14, wherein each pivotable connection between adjacent panels comprises a plurality of hinges formed by the longitudinal sides of adjacent panels, the hinge comprising an axle; and an axle receiver into which the axle is removably received, the axle being rotatable relative to the axle receiver.

17. The dishwasher appliance of claim 14, wherein the third rack assembly is supported on opposing lateral sides of the dishwasher appliance.

18. The dishwasher appliance of claim 14, further comprising a lock configured to selectively fix a position of the third rack assembly along the transverse direction.

19. A dishwasher appliance, comprising:

a tub defining a wash chamber for receipt of articles for washing; a first rack assembly slidably positioned within the wash chamber;

a first spray assembly positioned in the wash chamber and configured to direct wash fluid at the first rack assembly;

a second rack assembly slidably positioned in the wash chamber above the first rack assembly; a second spray assembly positioned in the wash chamber and configured to direct wash fluid at the second rack assembly;

a pair of opposing guide rails positioned in the wash chamber;

a third rack assembly supported by the pair of opposing guide rails and being slidably positioned in the wash chamber above the second rack assembly; and a third spray assembly positioned over the third rack assembly and configured to direct wash fluid at articles located in the third rack assembly;

the third rack assembly comprising:

a plurality of panels, each panel extending longitudinally along a lateral direction of the dishwasher appliance between opposing ends, each panel has a pair of opposing longitudinal sides;

a plurality of rollers connected at the opposing ends of at least one of the plurality of collapsible panels, each of the plurality of rollers being slidably received within tracks in the pair of opposing guide rails;

wherein the plurality of panels forms a plurality of pleats, wherein the pleats alternate between a top surface and a bottom surface of the third rack assembly, wherein the third rack assembly forms a plurality of adjacent troughs into which various articles may be placed for cleaning when in a partially or fully folded position, each trough formed by adjacent panels and including a pleat at a bottom of the trough, wherein adjacent panels along a transverse direction of the dishwasher appliance include a pivotable connection at the opposing longitudinal sides between adjacent panels that allows adjacent panels to fold towards each other such that the third rack assembly may be selectively collapsed or extended along the transverse direction in an accordion-like manner by movement of the plurality of panels towards or away from each other, respectively, wherein during the movement, the plurality of rollers slide within the tracks, and wherein during the movement, the plurality of panels remains vertically centered about a plane that includes the lateral and transverse directions.

20. The dishwasher appliance of claim 19, further comprising a lock configured to selectively fix a position of the third rack assembly along the transverse direction.

* * * * *